US012698931B2

(12) United States Patent
Suzuki

(10) Patent No.: US 12,698,931 B2
(45) Date of Patent: Aug. 4, 2026

(54) COOLING MECHANISM

(71) Applicant: DISCO CORPORATION, Tokyo (JP)

(72) Inventor: Hideyuki Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 175 days.

(21) Appl. No.: 18/742,118

(22) Filed: Jun. 13, 2024

(65) Prior Publication Data

US 2025/0003659 A1 Jan. 2, 2025

(30) Foreign Application Priority Data

Jun. 27, 2023 (JP) ..... 2023-105232

(51) Int. Cl.

*F25B 49/02* (2006.01)
*F25B 9/00* (2006.01)
*B24B 55/02* (2006.01)

(52) U.S. Cl.

CPC ..... *F25B 49/022* (2013.01); *F25B 9/008* (2013.01); *B24B 55/02* (2013.01); *F25B 2600/0253* (2013.01); *F25B 2600/2513* (2013.01); *F25B 2700/1931* (2013.01); *F25B 2700/1933* (2013.01); *F25B 2700/2103* (2013.01); *F25B 2700/21151* (2013.01); *F25B 2700/21152* (2013.01); *F25B 2700/21161* (2013.01); *F25B 2700/21163* (2013.01); *F25B 2700/21172* (2013.01); *F25B 2700/21173* (2013.01); *F25B 2700/21175* (2013.01)

(58) Field of Classification Search

CPC ..... F25B 2700/1933; F25B 2700/1931; F25B 2700/21151; F25B 2700/21152; F25B 2700/2102; F25B 2700/21163; F25B 2700/21161; F25B 2700/21175; F25B 2700/21171; F25B 2700/21172; F25B 2700/21173

See application file for complete search history.

(56) References Cited

U.S. PATENT DOCUMENTS 6,311,506 B1 * 11/2001 Takahashi ..... F25B 41/20 62/201
6,775,996 B2 * 8/2004 Cowans ..... B23Q 11/143 62/201
9,739,514 B2 * 8/2017 Seki ..... F25B 1/00
11,953,158 B2 * 4/2024 Werlen ..... F17C 5/007
12,352,482 B2 * 7/2025 Pamaraju ..... F25B 41/20
(Continued)

FOREIGN PATENT DOCUMENTS

JP 2007263488 A * 10/2007
JP 2008089289 A * 4/2008
(Continued)

*Primary Examiner* — Nelson J Nieves
(74) *Attorney, Agent, or Firm* — Greer Burns & Crain Ltd.

(57) ABSTRACT

A cooling mechanism includes a controller that controls the degree of opening of a variable expansion valve and the rotational speed of a compressor to cause a $CO_2$ coolant to follow a route that is defined by set pressure values and set temperatures in surrounding relation to a critical point specified by a critical temperature of 31.1° C. and a critical pressure of 7.38 Mpa, in order for a temperature value measured by a first temperature sensor or a second temperature sensor to reach a set temperature.

10 Claims, 4 Drawing Sheets

(56) References Cited

U.S. PATENT DOCUMENTS

2005/0178151 A1* 8/2005 Matsumoto ..... F25B 9/008 62/513
2005/0193752 A1* 9/2005 Eisenhower ..... F24H 15/281 62/180
2005/0268625 A1* 12/2005 Sienel ..... F25B 9/008 62/129
2006/0123827 A1* 6/2006 Achaichia ..... F25B 9/008 62/3.2
2006/0137385 A1* 6/2006 Take ..... F28D 1/05366 62/513
2007/0193292 A1* 8/2007 Itoh ..... B60H 1/3205 62/239
2008/0006044 A1* 1/2008 Tan ..... F25B 49/02 62/197
2010/0205987 A1* 8/2010 Okazaki ..... F25B 9/008 62/190
2010/0251757 A1* 10/2010 Hasegawa ..... F01C 11/004 62/468
2010/0287964 A1* 11/2010 Okamoto ..... F24D 11/0214 62/224
2011/0036119 A1* 2/2011 Fujimoto ..... F25B 1/10 62/510
2011/0247358 A1* 10/2011 Wada ..... F25B 9/008 62/510
2012/0198868 A1* 8/2012 Huff ..... F25B 9/008 62/126
2012/0297806 A1* 11/2012 Honda ..... F25B 41/34 62/222
2018/0156499 A1* 6/2018 Lifson ..... F25B 41/00
2019/0032849 A1* 1/2019 Seki ..... F25D 17/02
2019/0257562 A1* 8/2019 Walter ..... F25B 49/02
2020/0039323 A1* 2/2020 He ..... B60H 1/00914
2020/0039811 A1* 2/2020 Werlen ..... F25B 25/005
2020/0041072 A1* 2/2020 Werlen ..... F25B 9/008
2020/0283665 A1* 9/2020 Aydin ..... F25B 9/008
2021/0040366 A1* 2/2021 Goepfert ..... G01N 1/42
2022/0026121 A1* 1/2022 Braun ..... G01F 23/0007
2022/0221168 A1* 7/2022 Yoshimi ..... F24F 5/001
2024/0167741 A1* 5/2024 Yamawaki ..... F25B 49/02

FOREIGN PATENT DOCUMENTS

JP 2008121930 A * 5/2008 ..... F28D 15/0266
JP 2008164287 A * 7/2008
JP 2009115415 A * 5/2009 ..... F25B 40/00
JP 2017040396 A 2/2017

* cited by examiner

COOLING MECHANISM

BACKGROUND OF THE INVENTION

Field of the Invention

The present invention relates to a cooling mechanism for cooling a processing-assisting contributive liquid that assists in processing a workpiece in a processing apparatus.

Description of the Related Art

Wafers with a plurality of devices such as integrated circuits (Ics) and large-scale integration (LSI) circuits constructed on their face sides in respective areas demarcated by a plurality of projected dicing lines established thereon have their reverse sides ground by a grinding apparatus until they are reduced to a predetermined thickness. Thereafter, the wafers are divided into individual device chips by a dicing apparatus or a laser processing apparatus. The device chips thus fabricated will be used in electronic appliances including cellphones and personal computers.

While a wafer is being processed, e.g., ground or cut, by a processing tool mounted on a spindle unit included in a processing apparatus such as a grinding apparatus or a dicing apparatus, the spindle unit is heated and thermally expanded from processing the wafer, causing the processing tool to fail to grind or cut the wafer to a nicety. To eliminate the drawback, the grinding apparatus or the dicing apparatus includes a temperature control device for keeping the spindle unit at a constant temperature (see, for example, JP 2017-40396A).

SUMMARY OF THE INVENTION

The temperature control device disclosed in JP 2017-40396A uses $CO_2$ as a coolant to achieve a high cooling efficiency. However, if the temperature of a processing-assisting contributive liquid, which may include disposable processing water such as cutting water, that is used in the processing apparatus as assisting in processing the wafer is set to a low temperature, then the coolant that is introduced into a compressor in the processing apparatus cannot be fully vaporized, possibly bringing about liquid compression in the compressor that may be liable to shorten the service life of the compressor.

It is therefore an object of the present invention to provide a cooling mechanism that is capable of preventing liquid compression from occurring in a compressor.

In accordance with an aspect of the present invention, there is provided a cooling mechanism for cooling a processing-assisting contributive liquid used in a processing apparatus. The cooling mechanism includes a controller, a compressor for compressing a $CO_2$ coolant, a water-cooling gas cooler for cooling the $CO_2$ coolant that has retained heat generated when compressed by the compressor, an internal heat exchanger for being supplied with the $CO_2$ coolant that has been cooled by the water-cooling gas cooler, a vaporizer for vaporizing the $CO_2$ coolant delivered from the internal heat exchanger, thereby generating heat of vaporization, and cooling the processing-assisting contributive liquid used in the processing apparatus, a first pathway interconnecting the compressor and the water-cooling gas cooler, a second pathway interconnecting the water-cooling gas cooler and the vaporizer, a third pathway interconnecting the vaporizer and the compressor, a fourth pathway having a water control valve for introducing industrial water into the water-cooling gas cooler, and a bypass pathway interconnecting a first joint joined to the first pathway and a second joint joined to the second pathway and having a variable bypass valve. The internal heat exchanger is disposed across the second pathway and the third pathway such that the $CO_2$ coolant delivered from the vaporizer deprives heat from the $CO_2$ coolant delivered from the water-cooling gas cooler of heat. The cooling mechanism further includes a variable expansion valve that is disposed on the second pathway between the internal heat exchanger and the second joint and regulates a flow rate of the $CO_2$ coolant that has been cooled, a first pressure sensor that is disposed on either the second pathway or the third pathway between the variable expansion valve and the compressor and measures a pressure of the $CO_2$ coolant, a second pressure sensor that is disposed on either the first pathway or the second pathway between the compressor and the variable expansion valve and measures the pressure of the $CO_2$ coolant that has been compressed by the compressor, a first temperature sensor for measuring a temperature of the processing-assisting contributive liquid that flows out of the vaporizer, a second temperature sensor for measuring the temperature of the processing-assisting contributive liquid that flows into the vaporizer, a third temperature sensor for measuring a temperature of the industrial water flowing into the water-cooling gas cooler, a fourth temperature sensor for measuring the temperature of the $CO_2$ coolant delivered from the compressor, a fifth temperature sensor for measuring the temperature of the $CO_2$ coolant delivered from the water-cooling gas cooler, a sixth temperature sensor, disposed if necessary, for measuring the temperature of the $CO_2$ coolant delivered from the internal heat exchanger, a seventh temperature sensor, disposed if necessary, for measuring the temperature of the $CO_2$ coolant delivered from the vaporizer, which temperature is the same as the temperature of the $CO_2$ coolant delivered from the variable expansion valve, and an eighth temperature sensor for measuring the temperature of the $CO_2$ coolant delivered into the compressor. The controller includes a setting section for setting at least a first pressure value to be detected by the first pressure sensor, a second pressure value to be detected by the second pressure sensor, a first temperature to be detected by the first temperature sensor or a second temperature to be detected by the second temperature sensor, a fourth temperature to be detected by the fourth temperature sensor, a fifth temperature to be detected by the fifth temperature sensor, and an eighth temperature to be detected by the eighth temperature sensor, and the controller controls a degree of opening of the variable expansion valve and a rotational speed of the compressor to cause the $CO_2$ coolant to follow a route that is defined by the set pressure values and temperatures in surrounding relation to a critical point specified by a critical temperature of 31.1° C. and a critical pressure of 7.38 Mpa, in order for a temperature value measured by the first temperature sensor or the second temperature sensor to reach the set temperature.

Preferably, for reducing an extent to which the processing-assisting contributive liquid used in the processing apparatus is to be cooled, the controller reduces the degree of opening of the variable expansion valve to reduce the flow rate of the $CO_2$ coolant flowing in the vaporizer, and increases a degree of opening of the variable bypass valve on the bypass pathway so as to prevent the rotational speed of the compressor from reaching a lower limit value due to the reduction of the flow rate of the $CO_2$ coolant in the vaporizer, to increase the flow rate of the $CO_2$ coolant flowing in the vaporizer.

Preferably, for increasing the extent to which the processing-assisting contributive liquid used in the processing apparatus is to be cooled, the controller increases the degree of opening of the variable expansion valve and increases the rotational speed of the compressor to increase the flow rate of the $CO_2$ coolant flowing in the vaporizer, thereby vaporizing, in the internal heat exchanger, liquid $CO_2$ that remains in the $CO_2$ coolant delivered from the vaporizer, so that a burden on the compressor is reduced.

Preferably, the controller adjusts a degree of opening of the water control valve on the basis of the temperature of the industrial water that is detected by the third temperature sensor, thereby regulating a flow rate of the industrial water introduced into the water-cooling gas cooler, to control the cooling of the $CO_2$ coolant.

Preferably, the controller reduces the degree of opening of the variable expansion valve to increase a pressure value detected by the second pressure sensor or increases the degree of opening of the variable expansion valve to reduce a pressure value detected by the second pressure sensor, to adjust the pressure value to the set pressure value and thereby control a cooling efficiency (cooling ability/compression work).

Preferably, when it is assumed that a point A resides at an outlet of the compressor, a point B resides at an outlet of the water-cooling gas cooler, a point C resides at an outlet of the internal heat exchanger on the second pathway, a point D resides at an outlet of the variable expansion valve, a point E resides at an outlet of the vaporizer, a point F resides at an outlet of the internal heat exchanger on the third pathway, a temperature, a pressure, and an enthalpy at the point A are represented by TA, PA, and EA, respectively, a temperature, a pressure, and an enthalpy at the point B are represented by TB, PB, and EB, respectively, a temperature, a pressure, and an enthalpy at the point C are represented by TC, PC, and EC, respectively, a temperature, a pressure, and an enthalpy at the point D are represented by TD, PD, and ED, respectively, a temperature, a pressure, and an enthalpy at the point E are represented by TE, PE, and EE, respectively, and a temperature, a pressure, and an enthalpy at the point F are represented by TF, PF, and EF, respectively, the $CO_2$ coolant delivered from the point F to the compressor is compressed by the compressor and reaches the point A in excess of the critical point, where the temperature changes from TF to TA, the pressure changes from PF to PA, and the enthalpy changes from EF to EA, the $CO_2$ coolant delivered from the point A to the water-cooling gas cooler is cooled by the water-cooling gas cooler and reaches the point B where the temperature changes from TA to TB, the pressure remains unchanged (PA=PB), and the enthalpy changes from EA to EB, with a temperature difference between TA and TB and an enthalpy difference between EA and EB being discarded out of the cooling mechanism by the water-cooling gas cooler, the pressure PB and the temperature TB exceeding the critical point and the $CO_2$ coolant being not liquified, the $CO_2$ coolant delivered from the point B to the internal heat exchanger is deprived of heat by the $CO_2$ coolant delivered from the vaporizer and reaches the point C where the temperature changes from TB to TC, the pressure remains unchanged (PB=PC), and the enthalpy changes from EB to EC, with the temperature TC being lower than the critical point and the $CO_2$ coolant being partly liquified, the $CO_2$ coolant delivered from the point C to the variable expansion valve is decompressed by the variable expansion valve and reaches the point D where the temperature changes from TC to TD, the pressure changes from PC to PD, and the enthalpy remains unchanged (EC=ED), with the $CO_2$ coolant in a state where gas and liquid coexist, the $CO_2$ coolant delivered from the point D to the vaporizer deprives the processing-assisting contributive liquid of energy in the vaporizer and reaches the point E where the temperature and the pressure remain unchanged (TD=TE and PD=PE), the enthalpy changes from ED to EE, the point E starts to go on a saturation vapor curve passing through the critical point, turning the $CO_2$ coolant into gas, the $CO_2$ coolant delivered from the point E to the internal heat exchanger deprives the $CO_2$ coolant delivered from the point B to the internal heat exchanger of heat, with liquid that remains in the $CO_2$ coolant turning into gas, and reaches the point F where the temperature changes from TE to TF, the pressure remains unchanged (PE=PF), and the enthalpy changes from EE to EF, and the $CO_2$ coolant reaches the point A where an absolute value of a difference between EB and EC and an absolute value of a difference between EE and EF are equal to each other, and the controller controls the temperatures, the pressures, and the enthalpies to maximize a cooling efficiency (cooling ability/compression work)=(ED−EE)/(EF−EA).

Preferably, the temperature TA at the point A is detected by the fourth temperature sensor, the temperature TB at the point B is detected by the fifth temperature sensor, the temperature TC at the point C is detected by the sixth temperature sensor, the temperature TD at the point D is detected by the seventh temperature sensor, the temperature TE at the point E is detected by the seventh temperature sensor, the temperature TF at the point F is detected by the eighth temperature sensor, the pressure PA at the point A is detected by the second pressure sensor, the pressure PB at the point B is detected by the second pressure sensor, the pressure PC at the point C is detected by the second pressure sensor, the pressure PD at the point D is detected by the first pressure sensor, the pressure PE at the point E is detected by the first pressure sensor, the pressure PF at the point F is detected by the first pressure sensor, the enthalpy EA at the point A is determined on the basis of a p-h diagram, the enthalpy EB at the point B is determined on the basis of the p-h diagram, the enthalpy EC at the point C is determined on the basis of the p-h diagram, the enthalpy ED at the point D is determined on the basis of the p-h diagram, the enthalpy EE at the point E is determined on the basis of EF−(EB−EC), the enthalpy EF at the point F is determined on the basis of the p-h diagram, for calculating a cooling efficiency according to the equation: the cooling efficiency (cooling ability/compression work)=(ED−EE)/(EF−EA), the controller determines ED−EE=EC−{EF−(EB−EC)}=EB−EF on the basis of EC=ED and EE=EF−(EB−EC), and the controller increases the cooling ability and the cooling efficiency by increasing a difference (EB-EF) between the enthalpy EB and the enthalpy EF.

The sixth temperature sensor and the seventh temperature sensor may be dispensed with.

In the cooling mechanism according to the present invention, the controller controls the degree of opening of the variable expansion valve and the rotational speed of the compressor to cause the $CO_2$ coolant to follow a route that is defined by the set pressure values and temperatures in surrounding relation to a critical point specified by a critical temperature of 31.1° C. and a critical pressure of 7.38 Mpa, in order for a temperature value measured by the first temperature sensor or the second temperature sensor to reach the set temperature. Accordingly, liquid expansion is prevented from occurring in the compressor.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

A cooling mechanism according to a preferred embodiment of the present invention will be described below with reference to the accompanying drawings.

(Cooling Mechanism 2)

Figure 1:
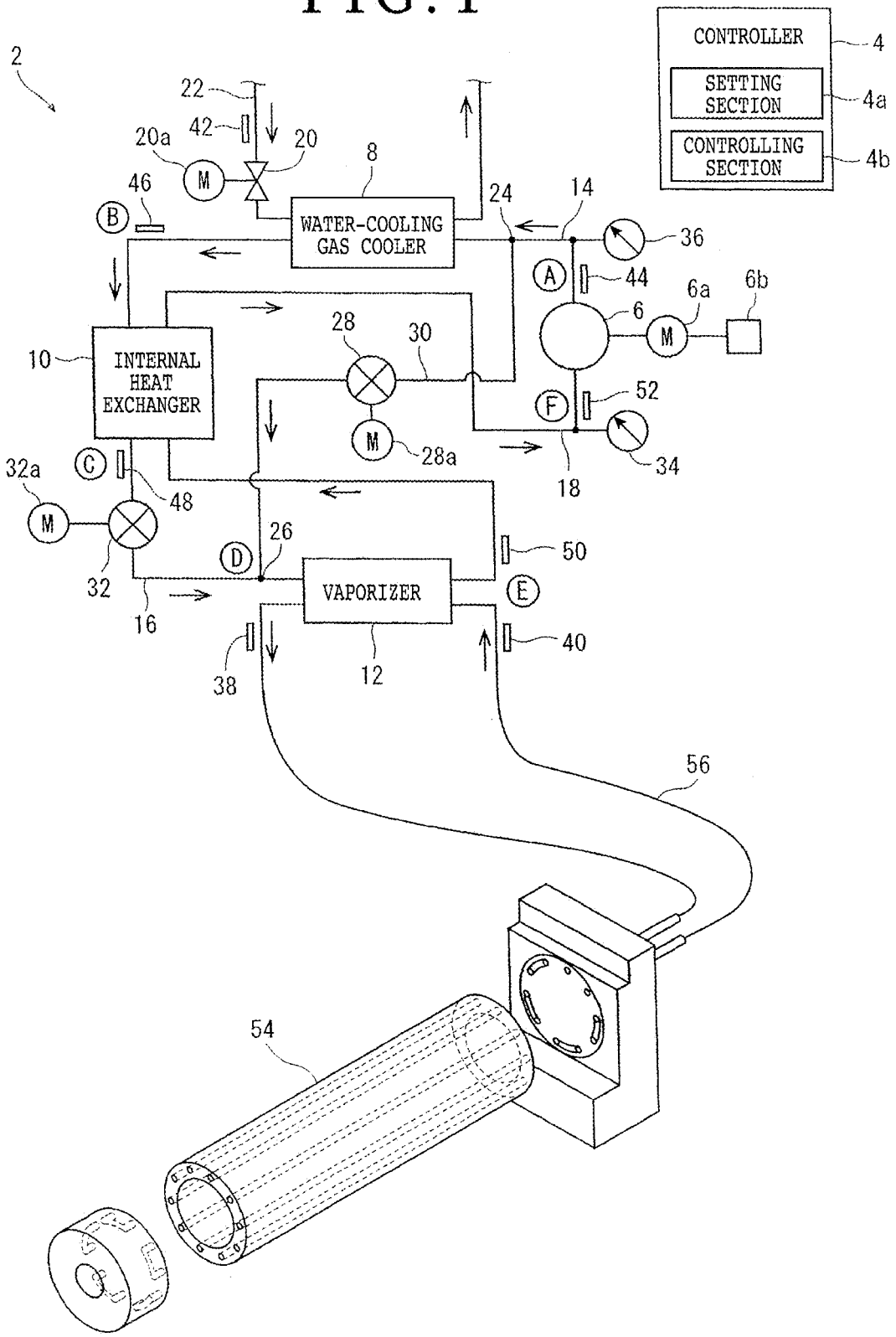
FIG. 1 is a fluid circuit diagram of a cooling mechanism according to an embodiment of the present invention.

FIG. 1 illustrates a cooling mechanism 2 for cooling a processing-assisting contributive liquid that assists in processing a workpiece in a processing apparatus with a coolant made of $CO_2$, which will hereinafter be referred to as a "$CO_2$ coolant." As illustrated in FIG. 1, the cooling mechanism 2 includes a controller 4, a compressor 6, a water-cooling gas cooler 8, an internal heat exchanger 10, and a vaporizer 12.

(Controller 4)

The controller 4 is implemented by a computer having a processor and a memory. According to the present embodiment, the controller 4 includes a setting section 4*a* and a controlling section 4*b*. The setting section 4*a* sets a pressure and a temperature for the $CO_2$ coolant on the basis of instructions entered by an operator, e.g., the temperature of the processing-assisting contributive liquid used in the processing apparatus. The controlling section 4*b* controls the degree of opening of a variable expansion valve 32 and the rotational speed of the compressor 6 in order to equalize the actual temperature of the processing-assisting contributive liquid with the set temperature, i.e., the temperature entered by the operator. Details of a control process performed by the controlling section 4*b* will be described in detail later.

(Compressor 6)

The compressor 6 compresses the $CO_2$ coolant as it circulates in the cooling mechanism 2. The compressor 6 is actuated by an electric motor 6*a* combined with an inverter 6*b*. The inverter 6*b* varies the frequency of electric power supplied to the electric motor 6*a* within a predetermined range, e.g., from 20 to 120 Hz, thereby varying the rotational speed of the electric motor 6*a* and hence varying the rotational speed of the compressor 6 in a range of allowable rotational speeds, i.e., between a lower limit value and an upper limit value thereof. The inverter 6*b* is electrically connected to the controller 4 and is controlled by the controlling section 4*b* of the controller 4.

(Water-Cooling Gas Cooler 8)

Figure 3:
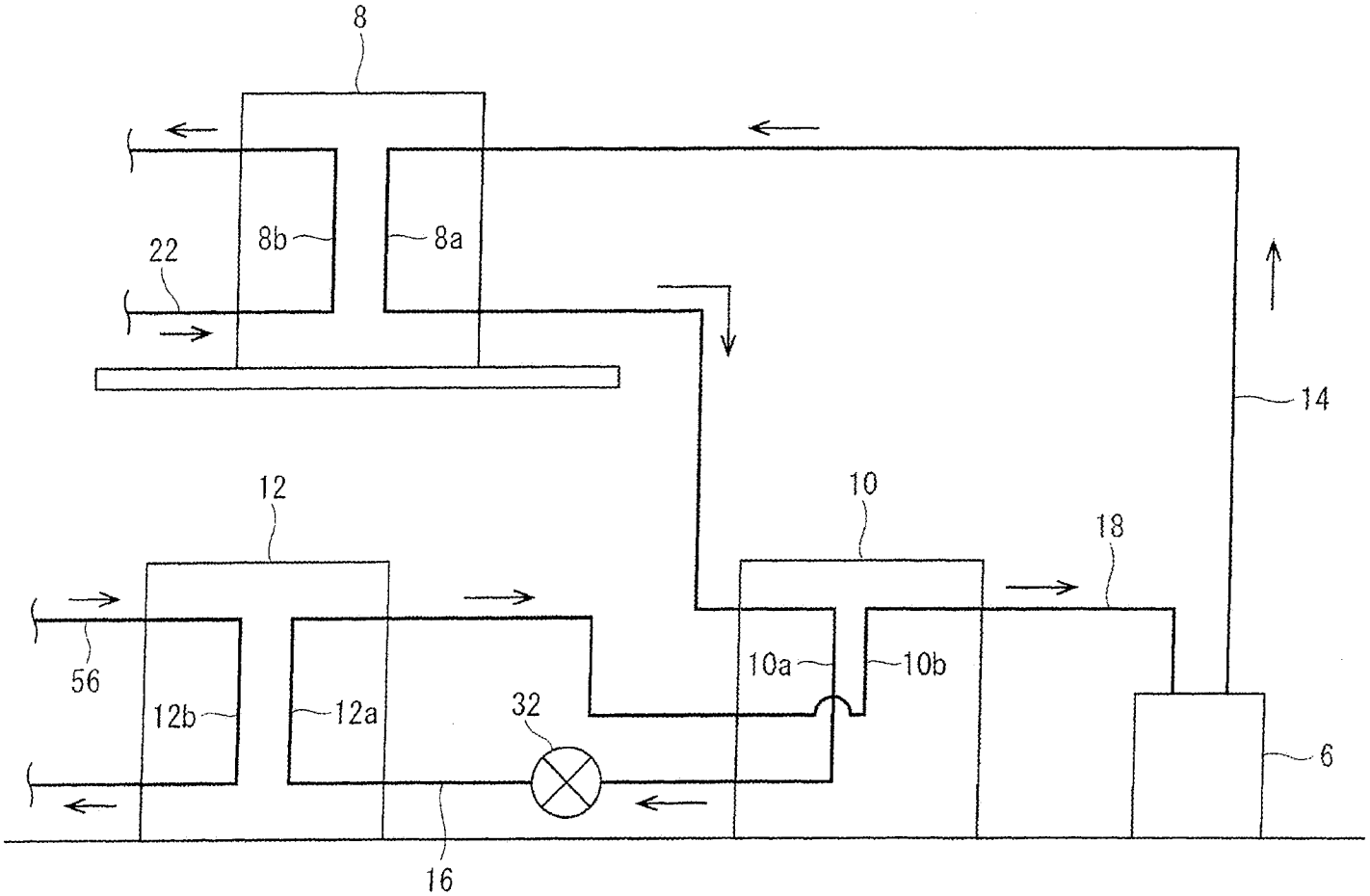
FIG. 3 is a schematic diagram illustrating by way of example of a layout of components of the cooling mechanism illustrated in FIG. 1.

The water-cooling gas cooler 8 cools the $CO_2$ coolant that has retained the heat generated when compressed by the compressor 6. As illustrated in FIG. 1, industrial water for cooling the $CO_2$ coolant is introduced into the water-cooling gas cooler 8. As illustrated in FIG. 3, the water-cooling gas cooler 8 has defined therein a coolant passage 8*a* through which the $CO_2$ coolant flows and a water passage 8*b* through which the industrial water flows. The water-cooling gas cooler 8 cools the $CO_2$ coolant with the industrial water by way of a heat exchange between the $CO_2$ coolant in the coolant passage 8*a* and the industrial water in the water passage 8*b*.

(Internal Heat Exchanger 10)

The $CO_2$ coolant that has been cooled by the water-cooling gas cooler 8 is delivered into the internal heat exchanger 10. As illustrated in FIG. 3, the internal heat exchanger 10 has defined therein a first passage 10*a* through which the $CO_2$ coolant cooled by the water-cooling gas cooler 8 flows and a second passage 10*b* through which the $CO_2$ coolant that has cooled the processing-assisting contributive liquid in the vaporizer 12. In the internal heat exchanger 10, a heat exchange occurs between the $CO_2$ coolant in the first passage 10*a* and the $CO_2$ coolant in the second passage 10*b*. The $CO_2$ coolant in the second passage 10*b* that has been delivered from the vaporizer 12 removes heat from the $CO_2$ coolant in the first passage 10*a* that has been delivered from the water-cooling gas cooler 8. In this manner, the $CO_2$ coolant that is partly left in liquid phase turns into gas in its entirely, as described in detail later.

(Vaporizer 12)

The vaporizer 12 vaporizes the $CO_2$ coolant delivered from the internal heat exchanger 10, generating heat of vaporization, and cools the processing-assisting contributive liquid used in the processing apparatus, with the generated heat of vaporization. As illustrated in FIG. 3, the vaporizer 12 has defined therein a coolant passage 12*a* through the which the $CO_2$ coolant flows and a contributive liquid passage 12*b* through which the processing-assisting contributive liquid flows. The vaporizer 12 cools the processing-assisting contributive liquid with the heat of vaporization generated by vaporizing $CO_2$ coolant, by way of a heat exchange between the $CO_2$ coolant in the coolant passage 12*a* and the processing-assisting contributive liquid in the processing-assisting contributive liquid passage 12*b*.

(First Through Fourth Pathways 14, 16, 18, and 22 and Bypass Pathway 30)

As illustrated in FIG. 1, the cooling mechanism 2 further includes a first pathway 14 interconnecting the compressor 6 and the water-cooling gas cooler 8, a second pathway 16 interconnecting the water-cooling gas cooler 8 and the vaporizer 12, a third pathway 18 interconnecting the vaporizer 12 and the compressor 6, a fourth pathway 22 having a water control valve 20 for introducing industrial water into the water-cooling gas cooler 8, and a bypass pathway 30 interconnecting a first joint 24 joined to the first pathway 14 and a second joint 26 joined to the second pathway 16 and having a variable bypass valve 28. The second pathway 16 has a variable expansion valve 32 for regulating the flow rate of the $CO_2$ coolant that has been cooled, between the internal heat exchanger 10 and the second joint 26. The second pathway 16 and the third pathway 18 extend through the internal heat exchanger 10.

(Water Control Valve 20, Variable Bypass Valve 28, and Variable Expansion Valve 32)

As illustrated in FIG. 1, the water control valve 20, the variable bypass valve 28, and the variable expansion valve 32 are coupled respectively with electric motors 20*a*, 28*a*, and 32*a* for adjusting their degrees of opening. The electric motors 20*a*, 28*a*, and 32*a* are electrically connected to the controller 4. The degrees of opening of the water control valve 20, the variable bypass valve 28, and the variable expansion valve 32 are adjusted by the respective electric motors 20*a*, 28*a*, and 32*a* on the basis of commands from the controlling section 4*b* of the controller 4.

In the cooling mechanism 2, the $CO_2$ coolant flows successively through the first, second, and third pathways 14, 16, and 18 to circulate from the compressor 6 successively through the water-cooling gas cooler 8, the internal heat exchanger 10, the vaporizer 12, and the internal heat exchanger 10 back to the compressor 6. According to the present embodiment, while the $CO_2$ coolant delivered from the compressor 6 flows back to the compressor 6, the $CO_2$ coolant generally passes twice through the internal heat exchanger 10. Specifically, the $CO_2$ coolant that has left the water-cooling gas cooler 8 flows through the internal heat exchanger 10 and then the vaporizer 12, and thereafter flows through the internal heat exchanger 10 again.

However, when the variable bypass valve 28 is open, part of the $CO_2$ coolant compressed by the compressor 6 flows through the bypass pathway 30 to the vaporizer 12, but not through the water-cooling gas cooler 8 and the internal heat exchanger 10.

(Pressure Sensors)

The cooling mechanism 2 also includes first and second pressure sensors 34 and 36 for measuring the pressure of the $CO_2$ coolant. Pressure values obtained by the first and second pressure sensors 34 and 36 are sent to the controller 4.

(First Pressure Sensor 34)

The first pressure sensor 34 measures the pressure of the $CO_2$ coolant expanded by the variable expansion valve 32. The first pressure sensor 34 may be disposed on either the second pathway 16 or the third pathway 18 somewhere between the variable expansion valve 32 and the compressor 6. According to the present embodiment, the first pressure sensor 34 is disposed on the third pathway 18 between the internal heat exchanger 10 and the compressor 6.

(Second Pressure Sensor 36)

The second pressure sensor 36 measures the pressure of the $CO_2$ coolant compressed by the compressor 6. The second pressure sensor 36 may be disposed on either the first pathway 14 or the second pathway 16 somewhere between the compressor 6 and the variable expansion valve 32. According to the present embodiment, the second pressure sensor 36 is disposed on the first pathway 14 between the compressor 6 and the water-cooling gas cooler 8.

(Temperature Sensors)

The cooling mechanism 2 further includes a plurality of temperature sensors for measuring the respective temperatures of the processing-assisting contributive liquid, the industrial water, and the $CO_2$ coolant. Temperature values obtained by the temperature sensors are sent to the controller 4.

(Sensor for Measuring Temperature of Processing-Assisting Contributive Liquid)

The sensor for measuring the temperature of the processing-assisting contributive liquid includes first and second temperature sensors 38 and 40. The first temperature sensor 38 measures the temperature of the processing-assisting contributive liquid that flows out of the vaporizer 12. The second temperature sensor 40 measures the temperature of the processing-assisting contributive liquid that flows into the vaporizer 12.

(Sensor for Measuring Temperature of Industrial Water)

The sensor for measuring the temperature of the industrial water includes a third temperature sensor 42. The third temperature sensor 42 measures the temperature of the industrial water that flows into the water-cooling gas cooler 8.

(Sensor for Measuring Temperature of $CO_2$ Coolant)

The sensor for measuring the temperature of the $CO_2$ coolant includes fourth through eighth temperature sensors 44, 46, 48, 50, and 52. The fourth temperature sensor 44 measures the temperature of the $CO_2$ coolant that is delivered from the compressor 6. The fifth temperature sensor 46 measures the temperature of the $CO_2$ coolant that is delivered from the water-cooling gas cooler 8. The sixth temperature sensor 48 measures the temperature of the $CO_2$ coolant that is delivered from the internal heat exchanger 10, i.e., the temperature of the $CO_2$ coolant that is to be delivered via the variable expansion valve 32 to the vaporizer 12. The seventh temperature sensor 50 measures the temperature of the $CO_2$ coolant that is delivered from the vaporizer 12, i.e., a temperature that is the same as the temperature of the $CO_2$ coolant that is delivered from the variable expansion valve 32. The eighth temperature sensor 52 measures the temperature of the $CO_2$ coolant that is delivered to the compressor 6. The sixth and seventh temperature sensors 48 and 50 can be dispensed with and may not be included in the cooling mechanism 2.

(Processing-Assisting Contributive Liquid)

The processing-assisting contributive liquid that is cooled by the cooling mechanism 2 is used in a processing apparatus, e.g., an unillustrated dicing apparatus, for cutting semiconductor wafers. The dicing apparatus includes cutting means for cutting semiconductor wafers. FIG. 1 illustrates in exploded perspective a spindle housing 54 that houses a spindle of the cutting means rotatably therein. The spindle housing 54 is fluidly coupled to the vaporizer 12 by a tubing 56. The processing-assisting contributive liquid circulates through the tubing 56 between the spindle housing 54 and the vaporizer 12.

However, the processing apparatus that incorporates the processing-assisting contributive liquid that is cooled by the cooling mechanism 2 is not limited to the dicing apparatus, and may be any of various processing apparatuses, e.g., a grinding apparatus for grinding semiconductor wafers to thin them down. The processing-assisting contributive liquid includes a circulating liquid that circulates in processing apparatuses and fluid that may be used and discarded as processing water, such as cutting water.

(Operation of Cooling Mechanism 2)

Now, operation of the cooling mechanism 2 described above will be described below. First, a basic mode of operation of the cooling mechanism 2, then a mode of operation for increasing the cooling ability and cooling efficiency of the cooling mechanism 2, and finally a mode of operation for increasing or reducing the extent to which the processing-assisting contributive liquid is to be cooled will be described below.

(Basic Mode of Operation)

When the operator enters an operation instruction into the controller 4 of the cooling mechanism 2, the setting section **4*a* of the controller 4 sets values, i.e., setting values, to be detected by the sensors, according to the operation instruction. Specifically, the setting section 4*a* sets a setting temperature for the processing-assisting contributive liquid and a setting pressure and a setting temperature for the $CO_2$ coolant. The setting temperature for the processing-assisting contributive liquid represents a temperature entered by the operator. The setting temperature and the setting temperature for the $CO_2$ coolant are determined by the controller 4** on the basis of the setting temperature for the processing-assisting contributive liquid.

(Setting Temperature for Processing-Assisting Contributive Liquid: First and Second Temperatures)

The setting section 4*a* sets a first temperature to be detected by the first temperature sensor 38 or a second temperature to be detected by the second temperature sensor 40, as the setting temperature for the processing-assisting contributive liquid. The first temperature represents the setting temperature for the processing-assisting contributive liquid that flows out of the vaporizer 12. The second temperature represents the setting temperature for the processing-assisting contributive liquid that flows into the vaporizer 12. For example, the first temperature may be set to 23° C. whereas the second temperature may be set to 25° C.

(Setting Pressure for $CO_2$ Coolant: First and Second Pressure Values)

The setting section 4*a* sets a first pressure value to be detected by the first pressure sensor 34 and a second pressure value to be detected by the second pressure sensor 36, as the setting pressure for the $CO_2$ coolant. The first pressure value represents the setting pressure for the $CO_2$ coolant expanded by the variable expansion valve 32. The first pressure value may be approximately 4 Mpa (absolute pressure). The second pressure value represents the setting pressure for the $CO_2$ coolant compressed by the compressor 6. Since the second pressure value represents a pressure of the $CO_2$ coolant after being compressed, it is set to a value larger than the setting pressure for the $CO_2$ coolant prior to being compressed, i.e., the first pressure value. Specifically, the second pressure value may be approximately 10 Mpa (absolute pressure).

(Setting Temperature for $CO_2$ Coolant: Fourth, Fifth, and Eighth Temperatures)

The setting section 4*a* sets a fourth temperature to be detected by the fourth temperature sensor 44, a fifth temperature to be detected by the fifth temperature sensor 46, and an eighth temperature to be detected by the eighth temperature sensor 52, as the setting temperature for the $CO_2$ coolant. The fourth temperature represents the setting temperature for the $CO_2$ coolant delivered from the compressor 6. The fourth temperature is 100° C., for example. The fifth temperature represents the setting temperature for the $CO_2$ coolant delivered from the water-cooling gas cooler 8. The fifth temperature can be set to 31° C., for example. The eighth temperature represents the setting temperature for the $CO_2$ coolant delivered into the compressor 6. The eighth temperature may be approximately 20° C., for example.

The fifth temperature may be set depending on the temperature of the industrial water flowing into the water-cooling gas cooler 8, i.e., the temperature value measured by the third temperature sensor 42. For example, the fifth temperature may be set to a temperature that is 5° C. higher than the temperature of the industrial water flowing into the water-cooling gas cooler 8.

Specifically, if the temperature of the industrial water is 25° C., for example, then the fifth temperature is set to 30° C. How much a temperature set as the fifth temperature is to be higher than the temperature of the industrial water may be determined depending on the heat exchanging area, i.e., the heat exchanging rate, of the water-cooling gas cooler 8.

(Setting Temperature for $CO_2$ Coolant: Sixth and Seventh Temperatures)

If necessary, the setting section 4*a* may set a sixth temperature to be detected by the sixth temperature sensor 48 and a seventh temperature to be detected by the seventh temperature sensor 50, as the setting temperature for the $CO_2$ coolant. The sixth temperature represents the setting temperature for the $CO_2$ coolant delivered from the internal heat exchanger 10, i.e., the $CO_2$ coolant delivered through the variable expansion valve 32 to the vaporizer 12. The sixth temperature can be set to 22° C. The seventh temperature represents the setting temperature for the $CO_2$ coolant delivered from the vaporizer 12. The seventh temperature may be approximately 5° C., for example.

In this fashion, the setting section 4*a* sets at least the first pressure value to be detected by the first pressure sensor 34, the second pressure value to be detected by the second pressure sensor 36, the first temperature to be detected by the first temperature sensor 38 or the second temperature to be detected by the second temperature sensor 40, the fourth temperature to be detected by the fourth temperature sensor 44, the fifth temperature to be detected by the fifth temperature sensor 46, and the eighth temperature to be detected by the eighth temperature sensor 52. Further, the setting section 4*a* may set the sixth temperature to be detected by the sixth temperature sensor 48 and the seventh temperature to be detected by the seventh temperature sensor 50.

(Control by the Controlling Section 4*b*)

When the setting section 4*a* has set the setting temperature for the $CO_2$ coolant and the setting pressure and the setting temperature for the $CO_2$ coolant, the controlling section 4*b* controls the degree of opening of the variable expansion valve 32 and the rotational speed of the compressor 6 to cause the $CO_2$ coolant to follow a route that is defined by pressure values, i.e., the set first and second pressure values, and temperatures, i.e., the fourth through eighth temperatures, in surrounding relation to a critical point, in order for the temperature value measured by the first temperature sensor 38 or the second temperature sensor 40 to reach the set temperature, i.e., the first temperature or the second temperature.

(Degree of Opening of Variable Expansion Valve 32)

The pressure of the $CO_2$ coolant and the temperature of the processing-assisting contributive liquid can be regulated by control of the degree of opening of the variable expansion valve 32. As the degree of opening of the variable expansion valve 32 becomes larger, the flow rate of the $CO_2$ coolant flowing through the variable expansion valve 32 goes higher, reducing the pressure value detected by the second pressure sensor 36. Further, as the degree of opening of the variable expansion valve 32 increases, the flow rate of the $CO_2$ coolant flowing through the vaporizer 12 also increases, lowering the temperature values detected by the first and second temperature sensors 38 and 40, i.e., the temperature of the processing-assisting contributive liquid. When the degree of opening of the variable expansion valve 32 decreases, the pressure value detected by the second pressure sensor 36 increases, resulting in an increase in the temperature values detected by the first and second temperature sensors 38 and 40.

(Rotational Speed of Compressor 6)

In addition, the pressure of the $CO_2$ coolant can be regulated by control of the rotational speed of the compressor 6. As the rotational speed of the compressor 6 goes higher, since the amount of the $CO_2$ coolant introduced into the compressor 6 increases, the pressure value detected by the first pressure sensor 34 is lowered. Conversely, as the rotational speed of the compressor 6 goes lower, the pressure value detected by the first pressure sensor 34 is raised.

(Critical Point)

Figure 2:
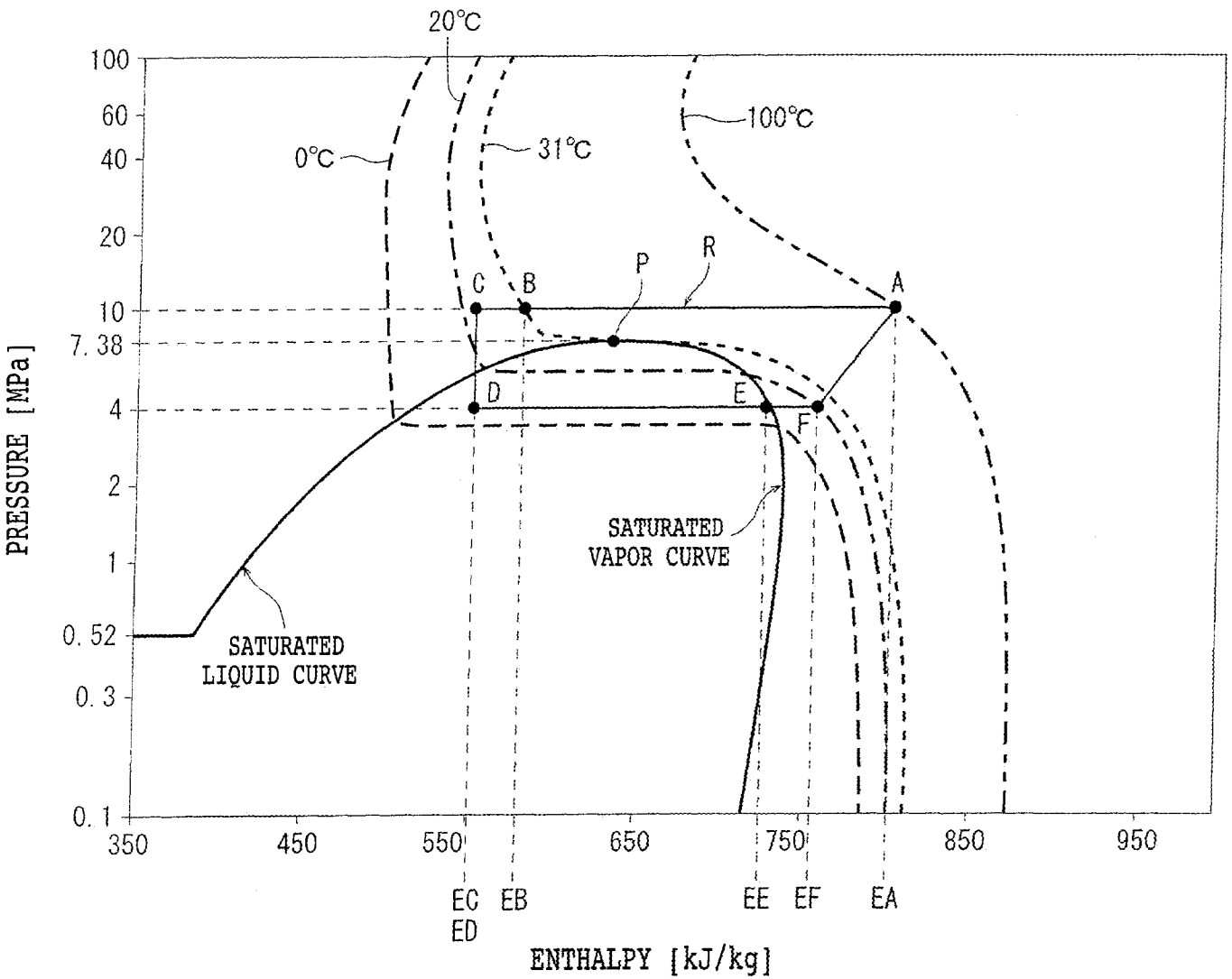
FIG. 2 is a p-h diagram of $CO_2$.

The critical point referred to above represents, in general, a point specified by the temperature and the pressure at which a substance is in a supercritical state. The critical point according to the present embodiment refers to a point specified by a critical temperature of 31.1° C. and a critical pressure of 7.38 Mpa where $CO_2$ as the coolant is in a supercritical state. In FIG. 2, the critical point for $CO_2$ is indicated by a symbol P. FIG. 2 is a p-h diagram of $CO_2$, i.e., a Mollier diagram, whose vertical axis represents pressures and horizontal axis enthalpies.

(Route Surrounding Critical Point)

The route surrounding the critical point, i.e., the route that is to be followed by the $CO_2$ coolant and is defined by set pressure values and temperatures in surrounding relation to a critical point, refers to, for example, a route R passing through points A, B, C, D, E, and F in FIG. 2. The points A through F in FIG. 2 are plotted on the basis of the temperatures and pressures respectively at points A through F in FIG. 1.

According to the present embodiment, as illustrated in FIG. 1, the point A resides at the outlet of the compressor 6, the point B resides at the outlet of the water-cooling gas cooler 8, the point C resides at the outlet of the internal heat exchanger 10 on the second pathway 16, the point D resides at the outlet of the variable expansion valve 32, the point E resides at the outlet of the vaporizer 12, and the point F resides at the outlet of the internal heat exchanger 10 on the third pathway 18.

Specific numerical values of the pressures and temperatures at the points A through F are given as illustrated in FIG. 2. The pressures at the points A, B, and C are 10 Mpa, for example, whereas the pressures at the points D, E, and F are 4 Mpa, for example. Specific examples of the temperatures at the points A through F are as follows: The temperature at the point A is approximately 100° C., the temperature at the point B is approximately 31° C., the temperature at the point C is approximately 22° C., the temperatures at the points D are E are approximately 5° C., and the temperature at the point F is approximately 20° C.

The temperatures, pressures, and enthalpies respectively at the points A through F will be described below using the following symbols:

- The temperature, pressure, and enthalpy at the point A are represented by TA, PA, and EA, respectively,
- the temperature, pressure, and enthalpy at the point B are represented by TB, PB, and EB, respectively,
- the temperature, pressure, and enthalpy at the point C are represented by TC, PC, and EC, respectively,
- the temperature, pressure, and enthalpy at the point D are represented by TD, PD, and ED, respectively,
- the temperature, pressure, and enthalpy at the point E are represented by TE, PE, and EE, respectively, and
- the temperature, pressure, and enthalpy at the point F are represented by TF, PF, and EF, respectively.

(Flow of $CO_2$ Coolant: From Point F to Point A)

When the controlling section **4*b* starts its control process as described above, the $CO_2$ coolant delivered from the point F to the compressor 6 is compressed by the compressor 6** and reaches the point A where it exceeds the critical point. At this time, the temperature of the $CO_2$ coolant changes, i.e., increases, from TF to TA, the pressure of the $CO_2$ coolant changes, i.e., increases, from PF to PA, and the enthalpy of the $CO_2$ coolant changes, i.e., increases, from EF to EA.

(From Point a to Point B)

Then, the $CO_2$ coolant delivered from the point A to the water-cooling gas cooler 8 is cooled by the water-cooling gas cooler 8 and reaches the point B. At this time, the temperature of the $CO_2$ coolant changes, i.e., decreases, from TA to TB, the pressure of the $CO_2$ coolant remains unchanged, i.e., PA=PB, and the enthalpy of the $CO_2$ coolant changes, i.e., decreases, from EA to EB. The temperature difference between TA and TB and the enthalpy difference between EA and EB are discarded out of the cooling mechanism 2 by the water-cooling gas cooler 8 as the $CO_2$ coolant is deprived of heat by the industrial water. Since the pressure PB and the temperature TB of the $CO_2$ coolant are in excess of the critical point, the $CO_2$ coolant is not liquified at the point B.

(From Point B to Point C)

Then, the $CO_2$ coolant delivered from the point B to the internal heat exchanger 10 is deprived of heat by the $CO_2$ coolant delivered from the vaporizer 12, and then reaches the point C. At this time, the temperature of the $CO_2$ coolant changes, i.e., decreases, from TB to TC, the pressure of the $CO_2$ coolant remains unchanged, i.e., PB=PC, and the enthalpy of the $CO_2$ coolant changes, i.e., decreases, from EB to EC. Since the temperature TC of the $CO_2$ coolant is lower than the critical point, part of the $CO_2$ coolant is liquified at the point C.

(From Point C to Point D)

Then, the $CO_2$ coolant delivered from the point C to the variable expansion valve 32 is decompressed by the variable expansion valve 32 and reaches the point D. At this time, the temperature of the $CO_2$ coolant changes, i.e., decreases, from TC to TD, the pressure of the $CO_2$ coolant changes, i.e., decreases, from PC to PD, and the enthalpy of the $CO_2$ coolant remains unchanged, i.e., EC=ED. The $CO_2$ coolant at the point D is in a state where gas and liquid coexist.

(From Point D to Point E)

Then, the $CO_2$ coolant delivered from the point D to the vaporizer 12 deprives the processing-assisting contributive liquid of energy in the vaporizer 12 and reaches the point E. At this time, inasmuch as the heat removed from the processing-assisting contributive liquid is used to vaporize the liquid phase of the $CO_2$ coolant, the temperature of the $CO_2$ coolant remains unchanged, i.e., TD=TE. The pressure of the $CO_2$ coolant also remains unchanged, i.e., PD=PE. However, the enthalpy of the $CO_2$ coolant changes, i.e., increases, from ED to EE. The point E starts to go on the saturation vapor curve passing through the critical point, turning much of the $CO_2$ coolant into gas.

(From Point E to Point F)

Then, the $CO_2$ coolant delivered from the point E to the internal heat exchanger 10 deprives the $CO_2$ coolant delivered from the point B to the internal heat exchanger 10 of heat. Consequently, even if liquid remains in the $CO_2$ coolant at the point E, the liquid in the $CO_2$ coolant turns to gas in the internal heat exchanger 10. In other words, the $CO_2$ coolant that has reached the point F outside of the saturated vapor curve turns in its entirely to gas. Therefore, the $CO_2$ coolant delivered from the point F flows only as gas into the compressor 6, thereby reducing the burden on the compressor 6. When the $CO_2$ coolant travels from the point E to the point F, the temperature of the $CO_2$ coolant changes, i.e., increases, from TE to TF, the pressure of the $CO_2$ coolant remains unchanged, i.e., PE=PF, and the enthalpy of the $CO_2$ coolant changes, i.e., increases, from EE to EF.

In the cooling mechanism 2, the controlling section **4*b* thus controls the degree of opening of a variable expansion valve 32 and the rotational speed of the compressor 6 to cause the $CO_2$ coolant to follow the route R that is defined by pressure values, i.e., the first and second pressure values, and temperatures, i.e., the fourth through eighth temperatures, in surrounding relation to the critical point P, in order for the temperature value measured by the first temperature sensor 38 or the second temperature sensor 40 to reach the set temperature, i.e., the first temperature or the second temperature. As the $CO_2$ coolant delivered from the point F flows only as gas into the compressor 6**, no liquid compression arises.

(Cooling Ability)

The cooling ability of the cooling mechanism 2 will be described below. The cooling ability refers to an ability of the $CO_2$ coolant to cool the processing-assisting contributive liquid in the vaporizer 12. Consequently, using the enthalpies across the vaporizer 12, the cooling ability can be expressed by the following equation (1):

$$\text{Cooling ability} = ED - EE \tag{1}$$

where ED represents the enthalpy of the $CO_2$ coolant at the point D before the $CO_2$ coolant passes through the vaporizer 12 and EE represents the enthalpy of the $CO_2$ coolant at the point E after the $CO_2$ coolant has passed through the vaporizer 12.

However, the enthalpy EE of the $CO_2$ coolant at the point E cannot be derived even when the temperature and the pressure at the point E are detected. Specifically, the $CO_2$ coolant at the point E is in a state where gas and liquid coexist. The state change in the $CO_2$ coolant from the point D to the point E occurs at a constant temperature and pressure. Therefore, the temperature and the pressure at the point E are detected as the same values as the temperature and the pressure at the point D. Accordingly, the enthalpy EE of the $CO_2$ coolant at the point E cannot be derived even when the temperature and the pressure at the point E are detected. Incidentally, the temperature TE at the point E can be detected by the seventh temperature sensor 50, whereas the pressure PE at the point E can be detected by the first pressure sensor 34.

The enthalpies EA through ED and EF of the $CO_2$ coolant at the points A through D and F can be determined from the p-h diagram by use of the temperatures and the pressures detected at the points A through D and F.

The temperatures of the $CO_2$ coolant at the points A through D and F can be detected by the following sensors: The temperature TA at the point A can be detected by the fourth temperature sensor 44, the temperature TB at the point B can be detected by the fifth temperature sensor 46, the temperature TC at the point C can be detected by the sixth temperature sensor 48, the temperature TD at the point D can be detected by the seventh temperature sensor 50, and the temperature TF at the point F can be detected by the eighth temperature sensor 52.

The pressures of the $CO_2$ coolant at the points A through D and F can be detected by the following sensors: The pressure PA at the point A can be detected by the second pressure sensor 36, the pressure PB at the point B can be detected by the second pressure sensor 36, the pressure PC at the point C can be detected by the second pressure sensor 36, the pressure PD at the point D can be detected by the first pressure sensor 34, and the pressure PF at the point F can be detected by the first pressure sensor 34.

The enthalpies at the points A through D and F can be determined on the basis of the p-h diagram. Specifically, the enthalpy EA at the point A can be determined on the basis of the p-h diagram by use of the temperature and the pressure at the point A, the enthalpy EB at the point B can be determined on the basis of the p-h diagram by use of the temperature and the pressure at the point B, the enthalpy EC at the point C can be determined on the basis of the p-h diagram by use of the temperature and the pressure at the point C, the enthalpy ED at the point D can be determined on the basis of the p-h diagram by use of the temperature and the pressure at the point D, and the enthalpy EF at the point F can be determined on the basis of the p-h diagram by use of the temperature and the pressure at the point F.

The cooling ability referred to above is expressed by use of the enthalpies that can be determined on the basis of the p-h diagram, as follows:

Using the enthalpy EF at the point F, the above equation (1) can be modified into the following equation (2):

$$\begin{aligned}\text{Cooling ability} &= ED - EE \\ &= (EF - EE) - (EF - ED)\end{aligned} \tag{2}$$

From the heat exchange performed in the internal heat exchanger 10, derived is the following equation (3):

$$|EB - EC| = |EE - EF| \tag{3}$$

As described above, the $CO_2$ coolant delivered from the point E to the internal heat exchanger 10 deprives the $CO_2$ coolant delivered from the point B to the internal heat exchanger 10 of heat. The enthalpy regarding the heat that the $CO_2$ coolant directed from the point E to the point F deprives of is expressed as |EE–EF|. The enthalpy regarding the heat that the $CO_2$ coolant directed from the point B to the point C is deprived of is expressed as |EB–EC|. Since these enthalpies are equal to each other, the above equation (3) is derived. In other words, the absolute value of the difference between EB and EC and the absolute value of the difference between EE and EF are equal to each other.

As described above, the enthalpy EC at the point C and the enthalpy ED at the point D are equal to each other, as expressed by the following equation (4):

$$EC = ED \tag{4}$$

The cooling ability can be expressed from the equations (2) through (4) by use of the enthalpies EB and EF that can determined on the basis of the p-h diagram, as expressed by the following equation (5):

$$\begin{aligned}\text{Cooling ability} &= (EF - EE) - (EF - ED) \\ &= (EB - EC) - (EF - EC) \\ &= EB - EF\end{aligned} \tag{5}$$

It can be understood from the equation (5) that the cooling ability increases when the difference (EB-EF) between the enthalpy EB and the enthalpy EF increases. Consequently, the controller 4 according to the present embodiment operates to increase the cooling ability by increasing the difference (EB-EF) between the enthalpy EB and the enthalpy EF. Specifically, the controller 4 performs a control process for increasing the cooling ability by reducing the degree of opening of the variable expansion valve 32 to increase the pressure value detected by the second pressure sensor 36 or increasing the degree of opening of the variable expansion valve 32 to reduce the pressure value detected by the second pressure sensor 36, thereby adjusting the pressure of the $CO_2$ coolant to the set pressure value, i.e., the first pressure value or the second pressure value.

Incidentally, the enthalpy EE at the point E can be calculated from the following equation (6), which is a modification of the equation (3):

$$EE = EF - (EB - EC) \tag{6}$$

(Cooling Efficiency)

The cooling efficiency of the cooling mechanism 2 will be described below. The cooling efficiency is obtained by dividing the cooling ability by compression work, i.e., work done by the compressor 6, as expressed by cooling efficiency=(cooling ability/compression work). Using the enthalpy EF at the point F, i.e., the enthalpy before compression, and the enthalpy EA at the point A, i.e., the enthalpy after compression, the compression work can be expressed by the following equation (7):

$$\text{Compression work} = EF - EA \tag{7}$$

Therefore, the cooling efficiency can be expressed from the equations (1) and (7) by the following equation (8):

$$\text{Cooling efficiency (cooling ability/compression work)} = (ED - EE)/(EF - EA) \tag{8}$$

The controller 4 should preferably control the temperatures, pressures, and enthalpies of the $CO_2$ coolant in order to maximize the cooling efficiency derived from the equation (8).

For calculating the cooling efficiency, the controller 4 according to the present embodiment determines the cooling ability according to the following equation (5) on the basis of the equation (4) (EC=ED) and the equation (6) {EE=EF−(EB−EC)}:

$$\begin{aligned}\text{Cooling efficiency} &= ED - EE \\ &= EC - \{EF - (EB - EC)\} \\ &= EB - EF\end{aligned} \tag{5}$$

By substituting the equation (5) in the equation (8), the cooling efficiency is expressed by the following equation (9):

$$\begin{aligned}\text{Cooling efficiency (cooling ability/compression work)} &= (ED - EE)/(EF - EA) \\ &= (EB - EF)/(EF - EA)\end{aligned} \tag{9}$$

It can be seen from the equation (9) that the cooling ability and the cooling efficiency increase when the difference (EB-EF) between the enthalpy EB and the enthalpy EF increases. Therefore, the controller 4 according to the present embodiment operates to increase the cooling ability and the cooling efficiency by increasing the difference (EB-EF) between the enthalpy EB and the enthalpy EF. Specifically, the controller 4 controls the cooling efficiency (cooling ability/compression work) by reducing the degree of opening of the variable expansion valve 32 to increase the pressure value detected by the second pressure sensor 36 or increasing the degree of opening of the variable expansion valve 32 to reduce the pressure value detected by the second pressure sensor 36, thereby adjusting the pressure of the $CO_2$ coolant to the set pressure value, i.e., the first pressure value or the second pressure value.

According to the equations (5) and (9), the sixth and seventh temperature sensors 48 and 50 can be dispensed with. To determine the cooling ability and the cooling efficiency from the equations (5) and (9), the values of the enthalpies EA, EB, and EF at the points A, B, and F are required. To determine the enthalpies EA, EB, and EF on the basis of the p-h diagram, the values of the temperatures TA, TB, and TF and the pressures PA, PB, and PF at the points A, B, and F are required. These values can be measured if the fourth, fifth, and eighth temperature sensors 44, 46, and 52 and the first and second pressure sensors 34 and 36 are included in the cooling mechanism 2. Therefore, according to the equations (5) and (9), the sixth and seventh temperature sensors 48 and 50 may not be included in the cooling mechanism 2.

The mode of operation for increasing or reducing the extent to which the processing-assisting contributive liquid used in the processing apparatus is to be cooled, i.e., for changing the setting temperature for the processing-assisting contributive liquid, will be described below.

(For Reducing Extent to which Processing-Assisting Contributive Liquid is to be Cooled)

First, a process of reducing the extent to which the processing-assisting contributive liquid used in the processing apparatus, i.e., increasing the setting temperature for the processing-assisting contributive liquid, will be described below. According to the process, the controlling section **4*b* of the controller 4 reduces the degree of opening of the variable expansion valve 32. Since the flow rate of the $CO_2$ coolant in the vaporizer 12 is now reduced, the extent to which the processing-assisting contributive liquid is to be cooled is reduced. As a result, the temperature value detected by the first temperature sensor 38 or the second temperature sensor 40** is increased.

Conversely, when the flow rate of the $CO_2$ coolant in the vaporizer 12 is reduced, the pressure value detected by the first pressure sensor 34 is lowered, and the pressure value detected by the second pressure sensor 36 is raised. As a result, the pressure value detected by the first pressure sensor 34 may become smaller than the first pressure value, and the pressure value detected by the second pressure sensor 36 may become larger than the second pressure value.

In order to increase the pressure value detected by the first pressure sensor 34 up to the first pressure value and reduce the pressure value detected by the second pressure sensor 36 down to the second pressure value, the controlling section **4*b* appropriately lowers the rotational speed of the compressor 6** depending on the amount by which the setting temperature for the processing-assisting contributive liquid is increased.

In this instance, even though the rotational speed of the compressor 6 has reached the lower limit value of the range of allowable rotational speeds, the pressure value detected by the first pressure sensor 34 may not rise to the first pressure value, and the pressure value detected by the second pressure sensor 36 may not fall to the second pressure value. When this happens, the controlling section 4*b* opens the variable bypass valve 28 that is normally closed, to thereby increase the flow rate of the $CO_2$ coolant in the vaporizer 12. In this manner, the pressure value detected by the first pressure sensor 34 can be raised to the first pressure value, and the pressure value detected by the second pressure sensor 36 can be lowered to the second pressure value, without lowering the rotational speed of the compressor 6 to a rotational speed lower than the lower limit value of the range of allowable rotational speeds.

Consequently, the cooling mechanism 2 is able to achieve a maximum cooling efficiency and a maximum cooling ability as the inlet pressure and the outlet pressure of the compressor 6 do not vary largely even if the setting temperature of the processing-assisting contributive liquid is increased.

As described above, for reducing the extent to which the processing-assisting contributive liquid is to be cooled, the controlling section 4*b* reduces the degree of opening of the variable expansion valve 32 to reduce the flow rate of the $CO_2$ coolant flowing in the vaporizer 12, and increases the degree of opening of the variable bypass valve 28 on the bypass pathway 30 so as to prevent the rotational speed of the compressor 6 from reaching the lower limit value due to the reduction of the flow rate of the $CO_2$ coolant in the vaporizer 12, to increase the flow rate of the $CO_2$ coolant flowing in the vaporizer 12.

(For Increasing Extent to which Processing-Assisting Contributive Liquid is to be Cooled)

Conversely, for increasing the extent to which the processing-assisting contributive liquid used in the processing apparatus is to be cooled, i.e., reducing the setting temperature for the processing-assisting contributive liquid, the controlling section 4*b* of the controller 4 increases the degree of opening of the variable expansion valve 32. Since the flow rate of the $CO_2$ coolant in the vaporizer 12 is now increased accordingly, the extent to which the processing-assisting contributive liquid needs to be cooled is increased. As a result, the temperature value detected by the first temperature sensor 38 or the second temperature sensor 40 is lowered.

However, when the flow rate of the $CO_2$ coolant in the vaporizer 12 is increased, the pressure value measured by the first pressure sensor 34 is increased, and the pressure value measured by the second pressure sensor 36 is reduced. As a consequence, the pressure value measured by the first pressure sensor 34 may become larger than the first pressure value, and the pressure value measured by the second pressure sensor 36 may become smaller than the second pressure value.

Then, the controlling section 4*b* appropriately raises the rotational speed of the compressor 6 depending on the amount by which the setting temperature for the processing-assisting contributive liquid is decreased. Accordingly, the pressure value measured by the first pressure sensor 34 is lowered to the first pressure value, and the pressure value measured by the second pressure sensor 36 is raised to the second pressure value.

Consequently, the cooling mechanism 2 is able to achieve a maximum cooling efficiency and a maximum cooling ability as the inlet pressure and the outlet pressure of the compressor 6 do not vary largely even if the setting temperature of the processing-assisting contributive liquid is decreased.

When the setting temperature of the processing-assisting contributive liquid is low, since the amount of the $CO_2$ coolant that is vaporized in the vaporizer 12 is reduced, the liquid phase of the $CO_2$ coolant may tend to be drawn into the compressor 6. However, with the cooling mechanism 2 according to the present embodiment, the $CO_2$ coolant that has egressed the vaporizer 12 and the $CO_2$ coolant that has egressed the water-cooling gas cooler 8 exchanges heat in the internal heat exchanger 10. In this heat exchange, the $CO_2$ coolant from the vaporizer 12 deprives the $CO_2$ coolant from the water-cooling gas cooler 8 of heat. Therefore, even if the liquid phase remains in the $CO_2$ coolant from the vaporizer 12, the liquid phase in the $CO_2$ coolant turns to gas in the internal heat exchanger 10.

In this manner, for increasing the extent to which the processing-assisting contributive liquid is to be cooled, the controlling section 4*b* increases the degree of opening of the variable expansion valve 32 and increases the rotational speed of the compressor 6 to increase the flow rate of the $CO_2$ coolant flowing in the vaporizer 12, thereby vaporizing, in the internal heat exchanger 10, the liquid $CO_2$ that remains in the $CO_2$ coolant delivered from the vaporizer 12, so that the burden on the compressor 6 is reduced.

(Adjustment of Degree of Opening of Water Control Valve 20)

Further, the controlling section 4*b* of the controller 4 should preferably adjust the degree of opening of the water control valve 20 on the basis of the temperature of the industrial water that is detected by the third temperature sensor 42, thereby regulating the flow rate of the industrial water to be introduced into the water-cooling gas cooler 8, to control the cooling of the $CO_2$ coolant.

When the degree of opening of the water control valve 20 increases, the amount of industrial water flowing into the water-cooling gas cooler 8 increases, promoting the cooling of the $CO_2$ coolant in the water-cooling gas cooler 8. Conversely, when the degree of opening of the water control valve 20 decreases, the amount of industrial water flowing into the water-cooling gas cooler 8 decreases, suppressing the cooling of the $CO_2$ coolant in the water-cooling gas cooler 8.

Therefore, the controlling section 4*b* can adjust the temperature of the $CO_2$ coolant delivered from the water-cooling gas cooler 8 to the setting temperature, i.e., the fifth temperature, by adjusting the degree of opening of the water control valve 20 on the basis of the temperature of the industrial water to thereby control the cooling of the $CO_2$ coolant in the water-cooling gas cooler 8.

In the cooling mechanism 2, inasmuch as the $CO_2$ coolant flowing into the compressor 6 is in the form of gas only, no liquid compression occurs in the compressor 6. Further, according to the present embodiment, as the cooling efficiency of the cooling mechanism 2 is determined according the equation (9), the pressure value of the $CO_2$ coolant for increasing the cooling efficiency can be set to match the operation state of the cooling mechanism 2.

$$\text{Cooling efficiency} = (EB - EF)/(EF - EA) \tag{9}$$

With respect to the layout of the compressor 6, the water-cooling gas cooler 8, the internal heat exchanger 10, and the vaporizer 12, it is preferable to place the water-cooling gas cooler 8 in a position higher than the compressor 6, the internal heat exchanger 10, and the vaporizer 12, as illustrated in FIG. 3.

When the $CO_2$ coolant reaches a supercritical state, lubricating oil in the compressor 6 tends to be dissolved in the $CO_2$ coolant and flow out of the compressor 6. If the lubricating oil from the compressor 6 that has been dissolved in the $CO_2$ coolant in the supercritical state stays stagnant in, for example, the water-cooling gas cooler 8 and the internal heat exchanger 10 and does not return to the compressor 6, the compressor 6 is liable to be abnormally worn.

The water-cooling gas cooler 8 placed, as illustrated in FIG. 3, in the position higher than the compressor 6, the internal heat exchanger 10, and the vaporizer 12 is effective to reduce the footprint of the cooling mechanism 2 as a whole and also to cause the $CO_2$ coolant in the supercritical state to flow in a gravitational direction, i.e., a downward direction, in the water-cooling gas cooler 8 and the internal heat exchanger 10. Therefore, the lubricating oil from the compressor 6 that has been dissolved in the $CO_2$ coolant in the supercritical state is restrained from staying stagnant in, for example, the water-cooling gas cooler 8 and the internal heat exchanger 10 and flows back to the compressor 6. As a result, the compressor 6 is prevented from being abnormally worn.

The $CO_2$ coolant expanded by the variable expansion valve 32 flows in an antigravitational direction, i.e., an upward direction, in the vaporizer 12 and the internal heat exchanger 10. It is preferable to keep the lower ends of the compressor 6, the internal heat exchanger 10, and the vaporizer 12 level with each other, thereby minimizing any vertical positional differences between the outlet of the vaporizer 12, the inlet and outlet of the internal heat exchanger 10, and the inlet of the compressor 6 to make it easier for the lubricating oil to return to the compressor 6.

Figure 4:
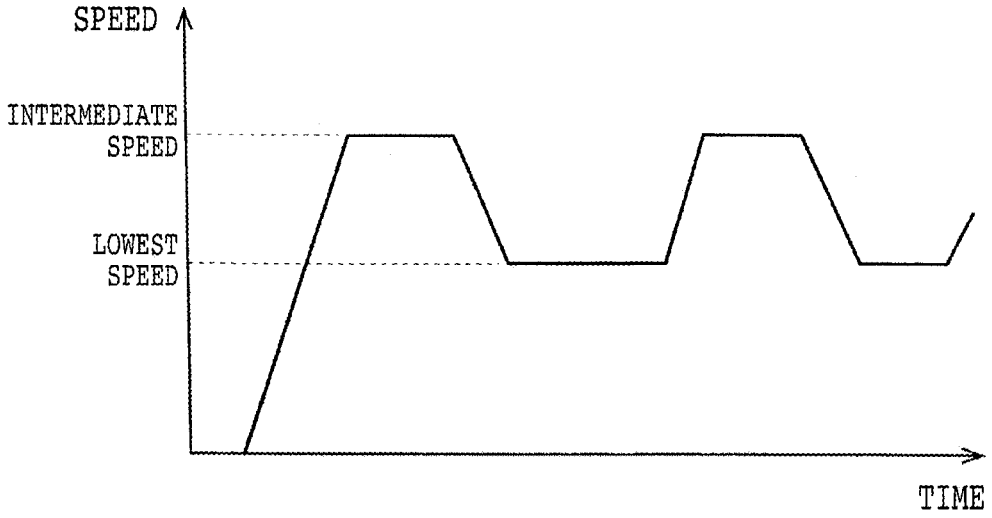
FIG. 4 is a graph illustrating by way of example the motor speed of a compressor at the time at which the compressor resumes its operation.

When the compressor 6 resumes its operation after shutdown, the compressor 6 should be actuated alternately at an intermediate speed and a lowest speed, each for a predetermined period of time, in several repetitive cycles, as illustrated in FIG. 4, while the variable expansion valve 32 and the variable bypass valve 28 are being kept at a predetermined degree of opening. In this fashion, the lubricant oil that has stayed stagnant in the internal heat exchanger 10 and the vaporizer 12 can efficiently be returned to the compressor 6 when the compressor 6 is shut off.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cooling mechanism for cooling a processing-assisting contributive liquid used in a processing apparatus, comprising:

a controller;

a compressor for compressing a $CO_2$ coolant;

a water-cooling gas cooler for cooling the $CO_2$ coolant that has retained heat generated when compressed by the compressor;

an internal heat exchanger for being supplied with the $CO_2$ coolant that has been cooled by the water-cooling gas cooler;

a vaporizer for vaporizing the $CO_2$ coolant delivered from the internal heat exchanger, thereby generating heat of vaporization, and cooling the processing-assisting contributive liquid used in the processing apparatus;

a first pathway interconnecting the compressor and the water-cooling gas cooler;

a second pathway interconnecting the water-cooling gas cooler and the vaporizer;

a third pathway interconnecting the vaporizer and the compressor;

a fourth pathway having a water control valve for introducing industrial water into the water-cooling gas cooler; and a bypass pathway interconnecting a first joint joined to the first pathway and a second joint joined to the second pathway and having a variable bypass valve, wherein the internal heat exchanger is disposed across the second pathway and the third pathway such that the $CO_2$ coolant delivered from the vaporizer deprives heat from the $CO_2$ coolant delivered from the water-cooling gas cooler, the cooling mechanism further includes a variable expansion valve that is disposed on the second pathway between the internal heat exchanger and the second joint and regulates a flow rate of the $CO_2$ coolant that has been cooled, a first pressure sensor that is disposed on either the second pathway or the third pathway between the variable expansion valve and the compressor and measures a pressure of the $CO_2$ coolant, a second pressure sensor that is disposed on either the first pathway or the second pathway between the compressor and the variable expansion valve and measures the pressure of the $CO_2$ coolant that has been compressed by the compressor, a first temperature sensor for measuring a temperature of the processing-assisting contributive liquid that flows out of the vaporizer, a second temperature sensor for measuring the temperature of the processing-assisting contributive liquid that flows into the vaporizer, a third temperature sensor for measuring a temperature of the industrial water flowing into the water-cooling gas cooler, a fourth temperature sensor for measuring the temperature of the $CO_2$ coolant delivered from the compressor, a fifth temperature sensor for measuring the temperature of the $CO_2$ coolant delivered from the water-cooling gas cooler, and an eighth temperature sensor for measuring the temperature of the $CO_2$ coolant delivered into the compressor, wherein:

the controller includes a setting section for setting at least a first pressure value to be detected by the first pressure sensor, a second pressure value to be detected by the second pressure sensor, a first temperature to be detected by the first temperature sensor or a second temperature to be detected by the second temperature sensor, a fourth temperature to be detected by the fourth temperature sensor, a fifth temperature to be detected by the fifth temperature sensor, and an eighth temperature to be detected by the eighth temperature sensor, and the controller controls a degree of opening of the variable expansion valve and a rotational speed of the compressor to cause the $CO_2$ coolant to follow a route that is defined by the set pressure values and temperatures in surrounding relation to a critical point specified by a critical temperature of 31.1° C. and a critical pressure of 7.38 Mpa, in order for a temperature value measured by the first temperature sensor or the second temperature sensor to reach the set temperature, and the controller enforces an enthalpy balance across the internal heat exchanger.

2. The cooling mechanism according to claim 1, wherein, for reducing an extent to which the processing-assisting contributive liquid used in the processing apparatus is to be cooled, the controller reduces the degree of opening of the variable expansion valve to reduce the flow rate of the $CO_2$ coolant flowing in the vaporizer, and increases a degree of opening of the variable bypass valve on the bypass pathway so as to prevent the rotational speed of the compressor from reaching a lower limit value due to the reduction of the flow rate of the $CO_2$ coolant in the vaporizer, to increase the flow rate of the $CO_2$ coolant flowing in the vaporizer.

3. The cooling mechanism according to claim 1, wherein, for increasing the extent to which the processing-assisting contributive liquid used in the processing apparatus is to be cooled, the controller increases the degree of opening of the variable expansion valve and increases the rotational speed of the compressor to increase the flow rate of the $CO_2$ coolant flowing in the vaporizer, thereby vaporizing, in the internal heat exchanger, liquid $CO_2$ that remains in the $CO_2$ coolant delivered from the vaporizer, so that a burden on the compressor is reduced.

4. The cooling mechanism according to claim 1, wherein the controller adjusts a degree of opening of the water control valve on a basis of the temperature of the industrial water that is detected by the third temperature sensor, thereby regulating a flow rate of the industrial water introduced into the water-cooling gas cooler, to control the cooling of the $CO_2$ coolant.

5. The cooling mechanism according to claim 1, wherein the controller reduces the degree of opening of the variable expansion valve to increase a pressure value detected by the second pressure sensor or increases the degree of opening of the variable expansion valve to reduce a pressure value detected by the second pressure sensor, to adjust the pressure value to the set pressure value and thereby control a cooling efficiency defined as a ratio of cooling ability to compression work.

6. The cooling mechanism according to claim 1, wherein, when it is assumed that a point A resides at an outlet of the compressor, a point B resides at an outlet of the water-cooling gas cooler, a point C resides at an outlet of the internal heat exchanger on the second pathway, a point D resides at an outlet of the variable expansion valve, a point E resides at an outlet of the vaporizer, a point F resides at an outlet of the internal heat exchanger on the third pathway, a temperature, a pressure, and an enthalpy at the point A are represented by TA, PA, and EA, respectively, a temperature, a pressure, and an enthalpy at the point B are represented by TB, PB, and EB, respectively, a temperature, a pressure, and an enthalpy at the point C are represented by TC, PC, and EC, respectively, a temperature, a pressure, and an enthalpy at the point D are represented by TD, PD, and ED, respectively, a temperature, a pressure, and an enthalpy at the point E are represented by TE, PE, and EE, respectively, and a temperature, a pressure, and an enthalpy at the point F are represented by TF, PF, and EF, respectively, the $CO_2$ coolant delivered from the point F to the compressor is compressed by the compressor and reaches the point A in excess of the critical point, where the temperature changes from TF to TA, the pressure changes from PF to PA, and the enthalpy changes from EF to EA, the $CO_2$ coolant delivered from the point A to the water-cooling gas cooler is cooled by the water-cooling gas cooler and reaches the point B where the temperature changes from TA to TB, the pressure remains unchanged (PA=PB), and the enthalpy changes from EA to EB, with a temperature difference between TA and TB and an enthalpy difference between EA and EB being discarded out of the cooling mechanism by the water-cooling gas cooler, the pressure PB and the temperature TB exceeding the critical point and the $CO_2$ coolant being not liquefied, the $CO_2$ coolant delivered from the point B to the internal heat exchanger is deprived of heat by the $CO_2$ coolant delivered from the vaporizer and reaches the point C where the temperature changes from TB to TC, the pressure remains unchanged (PB=PC), and the enthalpy changes from EB to EC, with the temperature TC being lower than the critical point and the $CO_2$ coolant being partly liquefied, the $CO_2$ coolant delivered from the point C to the variable expansion valve is decompressed by the variable expansion valve and reaches the point D where the temperature changes from TC to TD, the pressure changes from PC to PD, and the enthalpy remains unchanged (EC=ED), with the $CO_2$ coolant in a state where gas and liquid coexist, the $CO_2$ coolant delivered from the point D to the vaporizer deprives the processing-assisting contributive liquid of energy in the vaporizer and reaches the point E where the temperature and the pressure remain unchanged (TD=TE and PD=PE), the enthalpy changes from ED to EE, the point E starts to go on a saturation vapor curve passing through the critical point, turning the $CO_2$ coolant into gas, the $CO_2$ coolant delivered from the point E to the internal heat exchanger deprives the $CO_2$ coolant delivered from the point B to the internal heat exchanger of heat, with liquid that remains in the $CO_2$ coolant turning into gas, and reaches the point F where the temperature changes from TE to TF, the pressure remains unchanged (PE=PF), and the enthalpy changes from EE to EF, and the $CO_2$ coolant reaches the point A where an absolute value of a difference between EB and EC and an absolute value of a difference between EE and EF are equal to each other, and the controller controls the temperatures, the pressures, and the enthalpies to maximize a cooling efficiency (cooling ability/compression work)=(ED-EE)/(EF-EA).

7. The cooling mechanism according to claim 6, wherein the temperature TA at the point A is detected by the fourth temperature sensor, the temperature TB at the point B is detected by the fifth temperature sensor, the temperature TC at the point C is detected by the sixth temperature sensor, the temperature TD at the point D is detected by the seventh temperature sensor, the temperature TE at the point E is detected by the seventh temperature sensor, the temperature TF at the point F is detected by the eighth temperature sensor, the pressure PA at the point A is detected by the second pressure sensor, the pressure PB at the point B is detected by the second pressure sensor, the pressure PC at the point C is detected by the second pressure sensor, the pressure PD at the point D is detected by the first pressure sensor, the pressure PE at the point E is detected by the first pressure sensor, the pressure PF at the point F is detected by the first pressure sensor, the enthalpy EA at the point A is determined on a basis of a p-h diagram, the enthalpy EB at the point B is determined on the basis of the p-h diagram, the enthalpy EC at the point C is determined on the basis of the p-h diagram, the enthalpy ED at the point D is determined on the basis of the p-h diagram, the enthalpy EE at the point E is determined on a basis of EF−(EB−EC), the enthalpy EF at the point F is determined on the basis of the p-h diagram, for calculating the cooling efficiency according to the equation: the cooling efficiency (cooling ability/compression work)=(ED−EE)/(EF−EA), the controller determines ED−EE=EC−{EF−(EB−EC)}=EB−EF on a basis of EC=ED and EE=EF−(EB−EC), and the controller increases the cooling ability and the cooling efficiency by increasing a difference (EB−EF) between the enthalpy EB and the enthalpy EF.

8. The cooling mechanism according to claim 1, further comprising:

a sixth temperature sensor for measuring the temperature of the $CO_2$ coolant delivered from the internal heat exchanger, and a seventh temperature sensor for measuring the temperature of the $CO_2$ coolant delivered from the vaporizer, which temperature is the same as the temperature of the $CO_2$ coolant delivered from the variable expansion valve.

9. The cooling mechanism according to claim 5, wherein the controller controls the variable expansion valve and the compressor such that an enthalpy difference between $CO_2$ coolant delivered from the water-cooling gas cooler and $CO_2$ coolant delivered from the internal heat exchanger is equal to an enthalpy difference between $CO_2$ coolant delivered from the vaporizer and $CO_2$ coolant delivered from the internal heat exchanger.

10. A cooling mechanism for cooling a processing-assisting contributive liquid used in a processing apparatus, comprising:

a controller;

a compressor for compressing a $CO_2$ coolant;

a water-cooling gas cooler for cooling the $CO_2$ coolant that has retained heat generated when compressed by the compressor;

an internal heat exchanger for being supplied with the $CO_2$ coolant that has been cooled by the water-cooling gas cooler;

a vaporizer for vaporizing the $CO_2$ coolant delivered from the internal heat exchanger, thereby generating heat of vaporization, and cooling the processing-assisting contributive liquid used in the processing apparatus;

a first pathway interconnecting the compressor and the water-cooling gas cooler;

a second pathway interconnecting the water-cooling gas cooler and the vaporizer;

a third pathway interconnecting the vaporizer and the compressor;

a fourth pathway having a water control valve for introducing industrial water into the water-cooling gas cooler; and a bypass pathway interconnecting a first joint joined to the first pathway and a second joint joined to the second pathway and having a variable bypass valve, wherein the internal heat exchanger is disposed across the second pathway and the third pathway such that the $CO_2$ coolant delivered from the vaporizer deprives heat from the $CO_2$ coolant delivered from the water-cooling gas cooler, the cooling mechanism further includes a variable expansion valve that is disposed on the second pathway between the internal heat exchanger and the second joint and regulates a flow rate of the $CO_2$ coolant that has been cooled, a first pressure sensor that is disposed on either the second pathway or the third pathway between the variable expansion valve and the compressor and measures a pressure of the $CO_2$ coolant, a second pressure sensor that is disposed on either the first pathway or the second pathway between the compressor and the variable expansion valve and measures the pressure of the $CO_2$ coolant that has been compressed by the compressor, a first temperature sensor for measuring a temperature of the processing-assisting contributive liquid that flows out of the vaporizer, a second temperature sensor for measuring the temperature of the processing-assisting contributive liquid that flows into the vaporizer, a third temperature sensor for measuring a temperature of the industrial water flowing into the water-cooling gas cooler, a fourth temperature sensor for measuring the temperature of the $CO_2$ coolant delivered from the compressor, a fifth temperature sensor for measuring the temperature of the $CO_2$ coolant delivered from the water-cooling gas cooler, a sixth temperature sensor for measuring the temperature of the $CO_2$ coolant delivered from the internal heat exchanger, a seventh temperature sensor for measuring the temperature of the $CO_2$ coolant delivered from the vaporizer, which temperature is the same as the temperature of the $CO_2$ coolant delivered from the variable expansion valve, and an eighth temperature sensor for measuring the temperature of the $CO_2$ coolant delivered into the compressor, wherein:

the controller includes a setting section for setting at least a first pressure value to be detected by the first pressure sensor, a second pressure value to be detected by the second pressure sensor, a first temperature to be detected by the first temperature sensor or a second temperature to be detected by the second temperature sensor, a fourth temperature to be detected by the fourth temperature sensor, a fifth temperature to be detected by the fifth temperature sensor, and an eighth temperature to be detected by the eighth temperature sensor, and the controller controls a degree of opening of the variable expansion valve and a rotational speed of the compressor to cause the $CO_2$ coolant to follow a route that is defined by the set pressure values and temperatures in surrounding relation to a critical point specified by a critical temperature of 31.1° C. and a critical pressure of 7.38 Mpa, in order for a temperature value measured by the first temperature sensor or the second temperature sensor to reach the set temperature, wherein, when it is assumed that:

a point A resides at an outlet of the compressor, a point B resides at an outlet of the water-cooling gas cooler, a point C resides at an outlet of the internal heat exchanger on the second pathway, a point D resides at an outlet of the variable expansion valve, a point E resides at an outlet of the vaporizer, a point F resides at an outlet of the internal heat exchanger on the third pathway, a temperature, a pressure, and an enthalpy at the point A are represented by TA, PA, and EA, respectively, a temperature, a pressure, and an enthalpy at the point B are represented by TB, PB, and EB, respectively, a temperature, a pressure, and an enthalpy at the point C are represented by TC, PC, and EC, respectively, a temperature, a pressure, and an enthalpy at the point D are represented by TD, PD, and ED, respectively, a temperature, a pressure, and an enthalpy at the point E are represented by TE, PE, and EE, respectively, and a temperature, a pressure, and an enthalpy at the point F are represented by TF, PF, and EF, respectively, the $CO_2$ coolant delivered from the point F to the compressor is compressed by the compressor and reaches the point A in excess of the critical point, where the temperature changes from TF to TA, the pressure changes from PF to PA, and the enthalpy changes from EF to EA, the $CO_2$ coolant delivered from the point A to the water-cooling gas cooler is cooled by the water-cooling gas cooler and reaches the point B where the temperature changes from TA to TB, the pressure remains unchanged (PA=PB), and the enthalpy changes from EA to EB, with a temperature difference between TA and TB and an enthalpy difference between EA and EB being discarded out of the cooling mechanism by the water-cooling gas cooler, the pressure PB and the temperature TB exceeding the critical point and the $CO_2$ coolant being not liquified, the $CO_2$ coolant delivered from the point B to the internal heat exchanger is deprived of heat by the $CO_2$ coolant delivered from the vaporizer and reaches the point C where the temperature changes from TB to TC, the pressure remains unchanged (PB=PC), and the enthalpy changes from EB to EC, with the temperature TC being lower than the critical point and the $CO_2$ coolant being partly liquified, the $CO_2$ coolant delivered from the point C to the variable expansion valve is decompressed by the variable expansion valve and reaches the point D where the temperature changes from TC to TD, the pressure changes from PC to PD, and the enthalpy remains unchanged (EC=ED), with the $CO_2$ coolant in a state where gas and liquid coexist, the $CO_2$ coolant delivered from the point D to the vaporizer deprives the processing-assisting contributive liquid of energy in the vaporizer and reaches the point E where the temperature and the pressure remain unchanged (TD=TE and PD=PE), the enthalpy changes from ED to EE, the point E starts to go on a saturation vapor curve passing through the critical point, turning the $CO_2$ coolant into gas, the $CO_2$ coolant delivered from the point E to the internal heat exchanger deprives the $CO_2$ coolant delivered from the point B to the internal heat exchanger of heat, with liquid that remains in the $CO_2$ coolant turning into gas, and reaches the point F where the temperature changes from TE to TF, the pressure remains unchanged (PE=PF), and the enthalpy changes from EE to EF, and the $CO_2$ coolant reaches the point A where an absolute value of a difference between EB and EC and an absolute value of a difference between EE and EF are equal to each other, and the controller controls the temperatures, the pressures, and the enthalpies to maximize a cooling efficiency (cooling ability/compression work)=(ED−EE)/(EF−EA).

* * * * *